United States Patent [19]

Cherbuy et al.

[11] 4,430,957

[45] Feb. 14, 1984

[54] APPARATUS FOR APPLYING SOLID PARTICLES TO THE IMAGE CARRIER ON A NON-IMPACT PRINTER

[75] Inventors: Bernard Cherbuy, Belfort; Raymond Bongrain, Danjoutin, both of France

[73] Assignee: Cii/Honeywell Bull (Societe Anonyme), Paris, France

[21] Appl. No.: 465,613

[22] Filed: Feb. 10, 1983

[30] Foreign Application Priority Data

Feb. 11, 1982 [FR] France ..... 82 02205

[51] Int. Cl.[3] ..... G03G 15/09

[52] U.S. Cl. ..... 118/657; 355/3 DD

[58] Field of Search ..... 118/657, 658; 355/3 DD

*Primary Examiner*—Bernard D. Pianalto

*Attorney, Agent, or Firm*—Kerkam, Stowell, Kondracki & Clarke

[57] ABSTRACT

Apparatus for applying solid particles to the image carrier of a non-impact printer comprises a tank (6) containing a supply of the particles and includes a cylindrical conveying device (21) mounted for rotation in the tank on a first axis A3. A cylindrical conveying member (14) is also mounted for rotation in said tank on a second axis A2, while a first deflector (15) is interposed between the conveying member (14) and the carrier (2), and a second deflector (22) is interposed between the conveying device (21) and the conveying member (14) so as to cause transfer of particles in the tank to the conveying device (21), from there to the member (14) and thence to the carrier (2). Stirring devices (27) for stirring the particles in the tank may also be provided to establish a suitable reserve of particles and supply the particles to the conveying member with evenness.

20 Claims, 4 Drawing Figures

FIG. 2
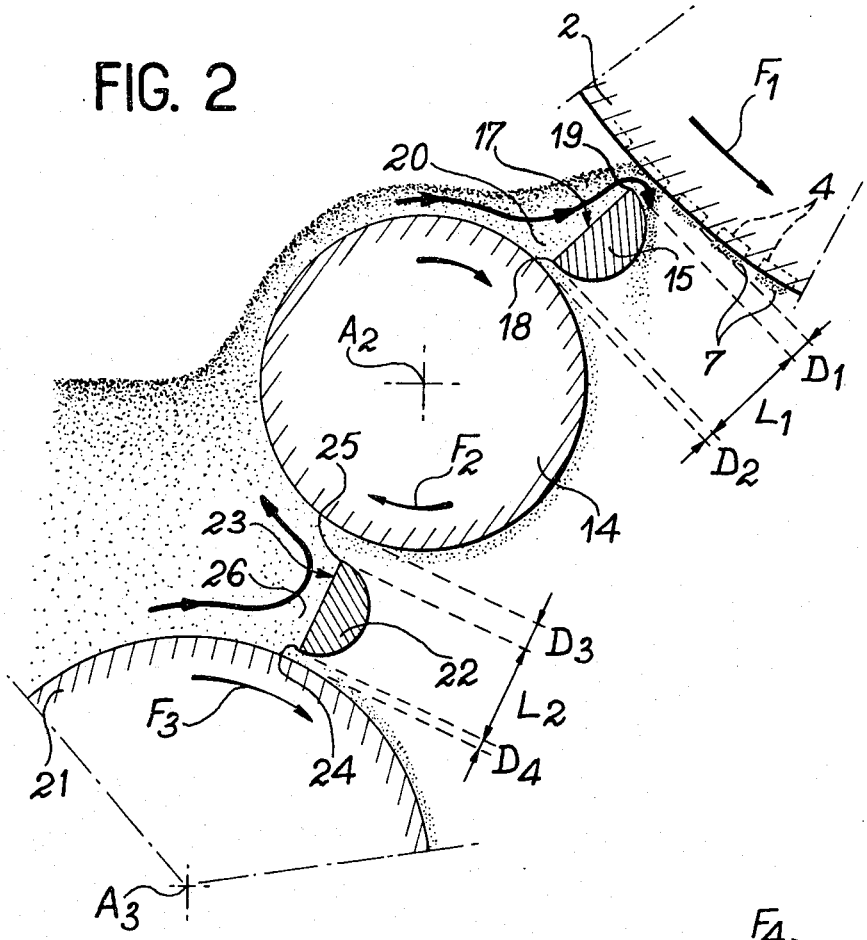
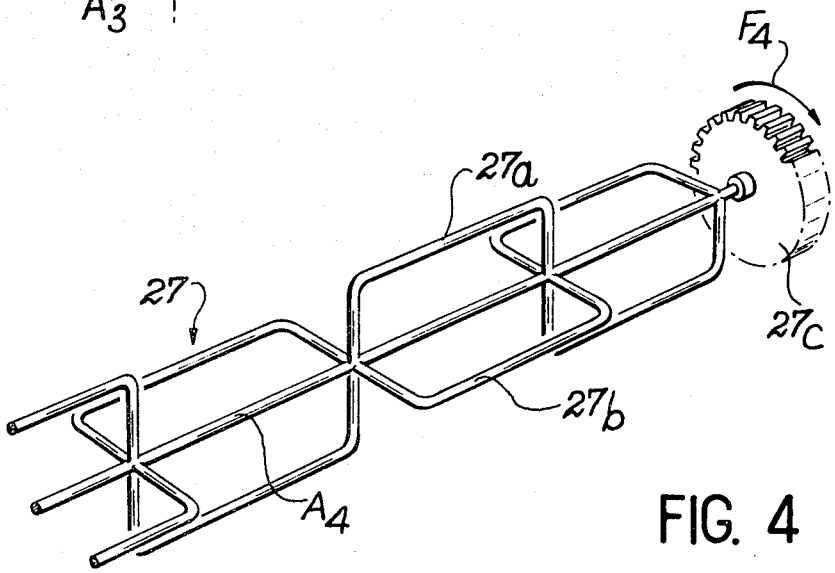
FIG. 4

APPARATUS FOR APPLYING SOLID PARTICLES TO THE IMAGE CARRIER ON A NON-IMPACT PRINTER

BACKGROUND OF THE INVENTION

1. Field of the Invention

The present invention is an improvement on the arrangements for the application of solid particles on the image carrier of a non-impact printer such as described in U.S. Pat. Nos. 4,246,588 issued on Jan. 20, 1981, and 4,348,684 issued on Sept. 7, 1982 to Compagnie Internationale pour l'Informatique CII-HONEYWELL BULL.

2. Description of the Prior Art

The present invention finds particular application to known forms of printing devices, such as non-impact or strike-less printers, in which the printing of characters is achieved without recourse to raised type impacting on a recipient sheet of paper.

Printing machines of this sort generally comprise an image carrier, most often constituted by a rotary drum or an endless belt on the surface of which sensitized zones can be formed by electrostatic or magnetic means. These zones, also referred to as latent images, correspond to the characters or figures to be printed. These latent images are then developed, i.e. made visible by means of a powdered developing pigment which, deposited on the image carrier, is attracted only by the latter's sensitized zones. The pigment particles which have thus been deposited on these latent images are thereafter transferred to a support sheet, such as a sheet of paper, to which they are affixed in a permanent manner.

To apply this powdered developing pigment to the image carrier of a printing machine of this type, various application arrangements have been used in the prior art. One form of arrangement which has been used includes a cylindrical housing containing the powdered pigment. This housing is provided with an aperture in front of which passes the image carrier. The inking of this carrier is effected by a cylindrical brush, rotating inside the casing and which projects the pigment particles toward the surface of the carrier as the carrier passes before the aperture in the housing.

This arrangement is not entirely satisfactory in practice, however, owing to the fact that it causes a cloud of pigment particles to be formed that spreads outside the housing. This is specially unpleasant for persons who come into contact with this cloud when standing near the printer. Another undesirable feature is that the particles become electrified in an undesirable way which, after being thrown onto the carrier, may cause them to cling to the unsensitized zones by electrostatic attraction.

The arrangements described in the aforenoted patents remedy these drawbacks. For example U.S. Pat. No. 4,246,588 discloses an arrangement for applying to the image carrier of a non-impact printer solid particles contained in a tank comprising a conveying member designed to carry these particles to the vicinity of the image carrier, said arrangement being characterized in that it also includes a deflector inserted between the carrier and the conveying member to collect the particles conveyed, the deflector has one of its edges disposed within the immediate proximity of said carrier so as to form with this carrier a trough of essentially prismatic shape in which are accumulated the particles thus collected, the carrier is moved in the direction in which it entrains these particles toward the edge of said prism. The particles entrained beyond this edge remain attached only to the sensitized zones of said carrier.

But the arrangement described in U.S. Pat. No. 4,246,588 presents the drawback of requiring frequent refilling of the tank containing the solid particles. The reason is that the conveying member, consisting for example of a rotary cylinder, ceases to supply particles to the image carrier as soon as the particle level in the tank falls below the bottom of the conveying member.

To remedy this drawback it is possible to imagine placing a first worm screw above the conveying member in order to supply it with the solid particles, as well as a second worm screw positioned parallel to the first one and with opposing thread so as to compensate for the lateral movement of the particles which would be caused by the first worm screw if it were to operate by itself. This prevents a total draining of the tank, owing to the stirring of the particles resulting from the movement of the two screws, and it is no longer necessary to fill the tank frequently.

However, worm screws are expensive pieces of equipment. Furthermore, they cannot be fully immersed in the powdered pigment because, on the one hand, the mechanical power then needed to turn these screws becomes very great and, on the other hand, in the case where the powdered pigment is made of particles coated with a thermoplastic resin, this pigment is subjected to milling and lamination by the screws, causing the resin to melt owing to the resulting friction, and to produce particle packing. In addition, some particles are pushed back against the various bearings provided in the tank walls to ensure rotation of the screws, and binding of the corresponding axes of rotation will result since there are no simple and effective means to seal the bearings. Also, the screws feed the particles to the conveying member in intermittent fashion, which creates concentrations of particles on the conveying member and, conversely, zones that are deprived of these particles, which is detrimental to the application of said particles to the conveying member.

SUMMARY OF THE INVENTION

The object of the present invention is to remedy the drawback of such feed arrangements comprising only one conveying member (combined with a deflector) as disclosed in the aforenoted patents, without the drawbacks of a worm screw arrangement as hereinfore discussed. More particularly it is an object of the present invention to provide an improved arrangement for applying solid particles to the image carrier of a non-impact printer, characterized in that it comprises a conveying device of cylindrical shape, designed to rotate on its axis in order to bring particles to the vicinity of a rotatable conveying member, as well as a deflector positioned between the conveying device and the conveying member to permit the transfer of particles from the conveying device to the conveying member. This arrangement prevents the tank from draining too rapidly. In addition, a conveying device of cylindrical shape is less costly than a worm screw, can be completely immersed in the powder of particles and, owing to the symmetry of the device, makes it possible for the powder to be fed smoothly onto the conveying member without binding in the bearings and without generating particle packing.

According to a particular characteristic of the object of the invention, this arrangement also includes a device for stirring the particles in the tank. This stirring device causes a re-spreading of the powder in the tank, which prevents any local draining of the latter.

According to another particular characteristic, said other deflector stretches over a length of the order of one centimeter, between said member and said conveying device, and leaves between itself and this conveying device a space at most equal to one millimeter, and between itself and said conveying device a space of the order of 5 mm.

Finally, according to another particular characteristic, the solid particles are capable of attraction by a magnet and said conveying device and said conveying member have magnetic surfaces.

BRIEF DESCRIPTION OF THE DRAWINGS

The nature of the invention will be better understood from the following descriptions of embodiments given by way of non-limiting examples and by referring to the attached drawings in which:

FIG. 2 is a line drawing of an embodiment of the invention showing, on the one hand, movement of the particles in the vicinity of a first deflector inserted between the conveying device and the image carrier, and, on the other hand, movement of the particles in the vicinity of a second deflector inserted between the conveying device and the conveying member;

FIG. 4 is a line drawing view of a particular embodiment of a stirring mechanism also used in the arrangement of FIG. 1.

DESCRIPTION OF THE PREFERRED EMBODIMENT

Figure 1:
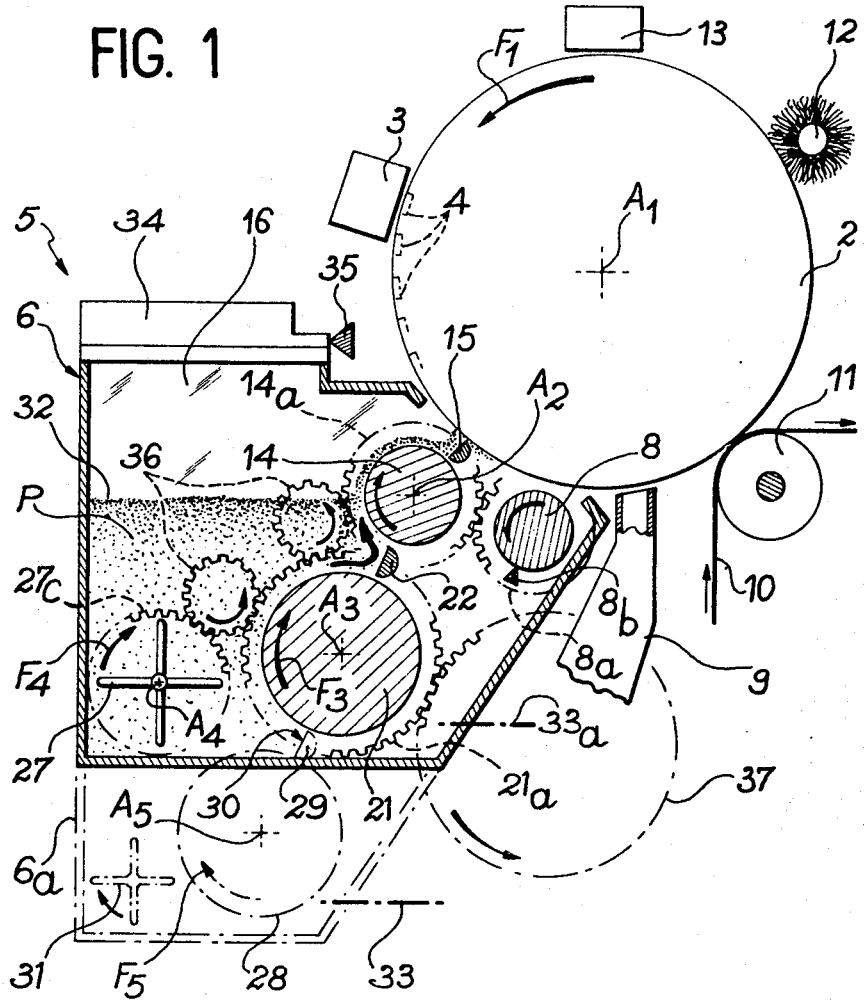
FIG. 1 is a line drawing of a particular embodiment of the object of the invention in the case of a magnetic printer.

FIG. 1 is a line drawing of a particular embodiment of the application arrangement 5 that is the object of the invention, in the case of a magnetic printer. A portion of that printer is shown diagrammatically in FIG. 1. Such printers are well known and explained in U.S. Pat. No. 4,246,588 comprise an image carrier consisting in the present embodiment of a magnetic drum 2 whose rotation in the direction of the arrow $F_1$ is produced by an electric motor (not shown). Information is recorded on the drum by means of a magnetic recording device 3. Device 3 may be formed by a unit that includes several magnetic recording heads, aligned parallel to the axis of rotation $A_1$ of drum 2. Each of these heads, as it is energized at different intervals by an electric current, generates a variable magnetic field, which has the effect of creating magnetized zones 4 or "magnetic points," on the surface of the drum which passes across the recording device 3. The energizing times for these heads are established in known fashion, so as to achieve on this drum surface magnetized zones which are units of said areas 4, units that are also called latent images and whose shapes correspond to those of the characters to be printed. The magnetized zones of the drum then pass before the applicator arrangement 5 which is positioned above drum 2 and which permits the application on the drum surface of particles of powdered pigment P contained in a tank 6. This pigment is made up of magnetic particles coated with a resin which, when heated, is capable of melting and of adhering permanently to the paper on which it has been deposited. It must be pointed out, however, that the nature of this pigment is not specific to this invention and that, in the case of an electrostatic printer—to which the invention also applies, of course—this pigment might well be made of a known powder without any magnetic particle.

The pigment adheres mainly to the magnetized zones 4, thus forming particle deposits 7 (FIG. 2) on the surface of drum 2. Retouching arrangements consisting of a rotary magnetic drum 8 positioned in the vicinity of drum 2 are then provided to eliminate the particles that have adhered outside the magnetized zones 4 as well as the excess particles present on said zones. A small deflector **8*b* is placed near the retouching cylinder 8 to make the particles picked up by this retouching cylinder fall into tank 6. But this retouching cylinder 8 creates chains of particles which adhere to drum 2** and which are eliminated by aspiration via another retouching device.

The particles remaining on the magnetized zones are transferred to a recipient sheet such as a sheet of paper pressed against the drum by means of a transfer roller 11. Finally, the particles left on the drum are removed at a cleaning post 12. Then the magnetic points are erased by an erasing module 13, after which a new printing cycle can take place.

As can be seen in FIG. 1, the applicator arrangement 5 includes, on the one hand, a conveying member 14 which picks up pigment particles located in tank 6 as long as the particle level in this tank is high enough, and takes them to the vicinity of the surface of drum 2, and, on the other hand, a fixed first deflector 15 which is inserted between the conveying member 14 and drum 2 to collect the particles conveyed by this member 14 and to apply them to the surface of drum 2.

The conveying member 14 consists, for example, of a magnetic cylinder whose axis of rotation $A_2$ is parallel to the axis $A_1$ of drum 2 and can rotate in two bearings (not shown) with which the lateral walls of tank 6 are provided. Only the rear lateral wall 16 is represented in FIG. 1, while the front lateral wall, located in front of FIG. 1 is not shown.

The deflector 15, shown in FIG. 2, is a piece attached to the two lateral walls of tank 6. Deflector 5 has a flat side 17, limited by a first and a second edge 18 and 19 that are parallel to the axes $A_1$ and $A_2$. The second edge 19 preferrably forms a sharp edge so as to avoid particle accumulation on said edge. Deflector 15 is positioned so that its side 17 forms with the plane defined by drum axis $A_1$ and member axis $A_2$ a dihedral whose edge is formed by the first edge 18 and is adjacent conveying member 14, and whose angle is less than 45°. In addition, this deflector 15 is positioned so that the sharp edge 19 is adjacent drum 2. By way of example, deflector 15 is constituted by a semicylindrical rod positioned so that said flat side 17 (i.e. the diametrical plane defining this rod) contains axes $A_1$ and $A_2$.

The conveying member 14 has a direction of rotation, indicated by the arrow $F_2$ in FIG. 2, designed to entrain the particles toward this side 17.

The space between the conveying member and the first edge 18 of the deflector is selected sufficiently small so that most of the particles are caught on the way through by deflector 15 and then accumulate in a trough 20 formed by the surface of conveying member 14 and side 17 of deflector 15. The direction of rotation of drum 2, indicated by arrow $F_1$ in FIG. 2, is selected so that the particles accumulating in trough 20 are entrained toward the sharp edge 19 of deflector 15 in such a manner that a portion of them can come to adhere to the magnetized zones of drum 2. Nevertheless, the particles entrained in this manner by drum 2 are not caught or impeded by deflector 15 on the way past edge 19, owing to the fact that edge 19 of the deflector does not touch the drum surface and therefore provides an aperture between sharp edge 19 and the drum whose width is sufficient to allow the pigment particles entrained by the drum to escape from trough 20. The pigment particles which, applied to the magnetized zones of the drum, escape from trough 20, continue to adhere to these zones and thereby form and make visible the characters which must be printed, while those particles that escape from trough 20 without being caught by or adhered to the drum generally fall back into tank 6.

According to the invention, the application arrangement 5 (FIG. 1) also includes, on the one hand, a conveying member 21 which picks up pigment particles located in tank 6 and brings them to the vicinity of the surface of conveying member 14, and, on the other hand, another or second deflector 22 which is inserted between conveying member 21 and conveying member 14 to collect the particles conveyed by conveying member 21 and to transfer them to the surface of conveying member 14. Said conveying member 21 is positioned inside tank 6, underneath conveying member 14 and consists of a cylinder which is magnetic in the present embodiment and whose axis of rotation $A_3$ is parallel to axes $A_1$ and $A_2$ defined above and disposed to rotate in two bearings (not shown) provided in the lateral walls of tank 6.

The other deflector 22, shown in FIG. 2, is a piece attached to the lateral walls of tank 6, presenting a flat side 23 limited by a first and a second edge, 24 and 25, both parallel to axis $A_1$ of conveying member 14 and to axis $A_2$ of conveying device 21. The other deflector 22 is positioned so that its flat side 23 forms with the plane defined by axes $A_1$ and $A_2$ a dihedral whose edge is formed by the first edge 24 and is adjacent conveying device 21 and whose angle is less than 45°. In addition, the other deflector is positioned so that its second edge 25 is adjacent the conveying member 14. By way of example, the other deflector 22 is constituted by a semi-cylindrical rod positioned so that its flat side 23 (i.e. the diametral plane defining this rod) contains the axes $A_2$ and $A_3$.

Conveying device 21 has a direction of rotation indicated by an arrow $F_3$ in FIG. 2 and determined in relation to the direction of rotation of conveying member 14 so as to entrain the particles toward conveying member 14. In other words, the directions of rotation are such as to create an ascending movement of pigment particles. In the embodiment shown in FIG. 2, the flat sides 17 and 23 are turned to the left, device 21 and member 14 are turning clockwise while drum 2 rotates counter-clockwise. It can thus be seen that there is a difference between the functions performed by the combination of conveying device 21, of the other deflector 22 and of conveying member 14, a combination which results in the moving away of the particles from the second edge of the other deflector, and of the combination of conveying member 14, of deflector 15 and of drum 2, a combination which results, on the contrary, in a moving closer of the particles to edge 19 and of deflector 15.

Drum 2 is thus supplied with particles as long as the particle level in tank 6 does not reach the bottom of conveying device 21, indicated by a chain-dotted line 33*a* defining a minimum level.

When the particle level has dropped to the point of reaching the top of conveying device 21, the particles continue to be entrained toward the other deflector 22 but they then accumulate in another trough formed by the surface of conveying device 21 and by the flat side 23 of the other deflector 22, before being entrained by conveying member 14. The space between the first edge 24 of the other deflector and conveying device 21 is selected sufficiently small so that most of the particles are caught by the other deflector 22 on the way through.

In order to further improve the continuity and the evenness of particle supply for conveying member 14 (FIG. 1), a stirring device 27 for the powdered pigment is added to tank 6. This stirring device 27 has an axis of rotation $A_4$ that is parallel to that of conveying device 21 and is supported by two bearings (not shown) provided on the lateral walls of tank 6. In the latter, said stirring device 27 is, for example, placed at the same level as and adjacent to conveying device 21. Actually, this conveying device 21 may be positioned at the bottom of tank 6 so that a maximum of particles from said tank are used up.

A particular embodiment of stirring device 27 is shown diagrammatically and partially in FIG. 4. It comprises essentially a central support rod extending along axis of rotation $A_4$ and two rods 27*a* and 27*b*, closely fitting the shape of battlements, rigidly locked to said central rod and positioned at right angle to each other. The rotation of stirring device 27 is determined, for example, to follow a direction, indicated by the arrow $F_4$ in FIG. 1, which is identical to the direction of rotation of conveying device 21. Rods 27*a* and 27*b* are arranged in spaced pairs along the central rod and displaced 180° in rotation with respect to the adjacent pair so that rods 27*a* are formed in a first plane and rods 27*b* in a second plane, the two planes being at right angle to each other and the rod in each plane having a castellated appearance.

The capacity of tank 6 can be increased further by making it deeper, which is indicated by chain-dotted lines 6*a* in FIG. 1, and by placing in this tank another conveying device 28, consisting of a magnetic cylinder and positioned underneath said conveying device 21. The axis of rotation $A_5$ of this other device 28 is parallel to axis $A_3$ and is supported by two bearings (not shown) placed in the lateral walls of tank 6. A third deflector is inserted between said device 21 and said other device 28. This other device thus supplies conveying device 21 with particles by means of the third deflector 29. This third deflector 29 is attached to the sidewalls of tank 6 and is, for example, similar to the other deflector 22; it thus presents a flat side 30 and is positioned between the other device 28 and conveying device 21, as the other deflector is positioned between this conveying device 21 and conveying member 14. The direction of rotation of said other device 28, indicated by an arrow $F_5$ in FIG. 1, is then selected to be identical to that of said conveying device 21. Member 14, device 21 and the other conveying device 28 can be positioned so that their respective axes of rotation are in the same plane and the other deflector 22 and the third deflector 29 can be placed so as to have their respective flat sides 23 (FIG. 2) and 30 (FIG. 1) in the same plane. Another stirring device 31 can also be added to tank 6 at the level of the other conveying device 28.

In tank 6, the particles can then vary from a maximum level 32 to a minimum level 33 corresponding to the bottom of the other conveying device 28. The latter does not intervene at the start, but it contributes to supplying drum 2 with particles when the level of these particles has dropped so as to reach the level of this other device 28.

There is thus a useful reserve of particles in tank 6 itself, which is more advantageous than a lateral external reserve combined with a supply system using an endless magnetized belt or one with scoops, a system that is difficult to control and which requires a sizable moment to drive and good tightness to prevent ink or pigment from penetrating between the drive cylinders and the belt.

Naturally, a level sensor could be provided to indicate to the users of the printer the moment when the minimum level 33 is reached.

Figure 3:
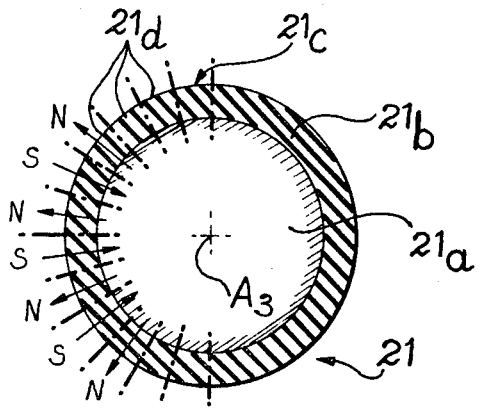
FIG. 3 is a line drawing showing the cross-section of a particular embodiment of the particle conveying device used in the arrangement of FIG. 1.

FIG. 3 presents a line drawing showing a particular embodiment of conveying device 21. It includes a cylinder 21*a* with an axis $A_3$, coated with a tape 21*b* that is permanently magnetized and which, in this embodiment, is made of rubber into which are incorporated metal particles that are permanently magnetized. FIG. 3 shows that this tape 21*b* has been magnetized so as to present on its external side 21*c* successive magnetized zones 21*d* whose polarity is such that any two consecutive magnetized zones are of opposite magnetic polarity. In other words, the polarity of these successive magnetized zones alternates between North and South, the North and South poles being indicated in FIG. 3 by the letters N and S, respectively. Under these conditions, a portion of the pigment particles located in tank 6 (FIG. 1) is attracted by tape 21*b*. It must be pointed out, however, that the magnetization method for tape 21*b*, described above, is not exclusive to this invention, and any other magnetization mode could be used that permits tape 21*b* to attract the pigment particles. The other conveying device 28 and conveying member 14 can be designed in the same manner.

FIG. 1 also shows the sliding cover 34 for tank 6, this cover being checked by a stop 35 in order not to damage drum 2.

The line drawing also represents a portion of the gears that allow rotation of the retouching arrangements 8 (gearwheel 8*a*), of conveying member 14 (gearwheel 14*a*), of conveying device 21 (gearwheel 21*a*) and of beater device 27 (gearwheel 27*c*). The drawing does not show the gearwheel that permits rotation of the other conveying device 28, nor the one that permits rotation of the other beater device 31, but their position should be apparent. Some of the intermediate gears 36 have also been shown which are required to achieve the proper directions of rotation as well as the drive gear 37 operated by a motor (not shown) and which permits driving all the other gears. This set of gears can be designed by those skilled in the art and positioned outside tank 6, for example, on the other side of outside wall 16 in FIG. 1.

By way of a non-limiting example, deflector 22 and the other deflector 29 are made of a magnetic material, the distances D1, D2, D3, D4 (FIG. 2), respectively between drum 2 and deflector 15, between the latter and conveying member 14, between the latter and the other deflector 22, between the latter and the other conveying device 21, are respectively equal to 1 mm, 0.5 mm, 5 mm, 0.5 mm; the respective widths L1 and L2 of sides 17 and 23 are of the order of 1 cm, and the speeds of rotation of conveying member 14 and of conveying device 21 are of the order of 50 rpm and 30 rpm, respectively. It will also be noted in FIG. 1 that, owing to the small spaces on either side of deflectors 22 and 29, these deflectors form with member 14, device 21 and the other conveying device 28 a sort of wall allowing confinement in large measure of pigment P to one side of the wall (left hand side in FIG. 1), so as not to interfere, in particular, with retouching cylinder 8.

We claim:

1. Apparatus for applying solid particles to the image carrier (2) of a non-impact printer comprising a tank (6) containing a supply of the particles, a first cylindrical conveying device (21) mounted for rotation in said tank on a first axis (A3), a cylindrical conveying member (14) mounted for rotation in said tank on a second axis (A2), a first deflector (15) interposed between the conveying member (14) and the carrier (2) and a second deflector (22) interposed between the conveying device (21) and the conveying member (14) to allow the transfer of particles from the conveying device (21) to the conveying member (14) and thence to the carrier (2) upon rotation of the first conveying device (21) and the conveying member (14).

2. Apparatus according to claim 1, further including a stirring device (27) in said tank for stirring the particles in the tank (6).

3. Apparatus according to claim 1 further including at least one other cylindrical conveying device (28) mounted for rotation in said tank on a third axis (A5), a third deflector (29) interposed between said first device (21) and said other conveying device (28) so as to allow maintenance of a reserve of particles in the tank (6) and to transfer particles from said reserve to said other device (28) and thence to said device (21) upon rotation of said devices.

4. Apparatus according to claim 1 wherein said second deflector (22) stretches over a distance of the order of one centimeter between said member (14) and said first conveying device (21) and leaves between itself and said first conveying device (21) a space at most equal to one millimeter and between itself and said conveying member (14) a space of the order of 5 mm.

5. Apparatus according to claim 1 wherein the solid particles are capable of attraction by a magnet, and said first conveying device (21) and said conveying member (14) have magnetic surfaces.

6. Apparatus according to claim 1 wherein said first and said second deflectors (15, 22) are fixed and each comprise a flat side, the flat side of the first deflector (15) being positioned to form with a plane defined by the axis (A1) of the carrier and the axis (A2) of said member (14) a dihedral having an edge adjacent the surface of the conveying member (14) and an edge adjacent the surface of the carrier.

7. Apparatus according to claim 1 wherein said first deflector (15) is a semi-cylindrical rod having its flat surface positioned in a diametral plane defining the rod and containing said axes of said carrier and of said member (A1 and A2).

8. Apparatus according to claim 1 wherein said first and second deflectors are fixed and each comprise a flat side, the flat side of the second deflector (22) being positioned to form with a plane defined by the axes (A1 and A2) of the carrier and the member (14), respectively, a dihedral having a first edge (24) adjacent said first conveying device (21) and a second edge (25) adjacent the conveying member (14).

9. Apparatus according to claim 1 wherein said second deflector (22) is a semi-cylindrical rod having its flat surface positioned in a diametral plane defining the rod and containing said axes (A2 and A3) of said member (14) and said first device (21), respectively.

10. Apparatus according to claim 6 wherein said first and said second deflectors are fixed and each comprise a flat side, the flat side of the second deflector (22) being positioned to form with a plane defined by the axes (A1 and A2) of the carrier and the member (14), respectively, a dihedral having a first edge (24) adjacent said first conveying device (21) and a second edge (25) adjacent the conveying member (14).

11. Apparatus according to claim 6 wherein said second deflector (22) is a semi-cylindrical rod having its flat surface positioned in a diametral plane defining the rod and containing said axes (A2 and A3) of said member (14) and said first device (21), respectively.

12. Apparatus according to claim 7 wherein said first and said second deflectors are fixed and each comprise a flat side, the flat side of the second deflector (22) being positioned to form with a plane defined by the axes A1 and A2 of the carrier and the member (14), respectively, a dihedral having a first edge (24) adjacent said first conveying device (21) and a second edge (25) adjacent the conveying member (14).

13. Apparatus according to claim 7 wherein said second deflector (22) is a semi-cylindrical rod having its flat surface positioned in a diametral plane defining the rod and containing said axes (A2 and A3) of said member (14) and said first device (21), respectively.

14. Apparatus according to claim 2 further including at least one other cylindrical conveying device (28) mounted for rotation in said tank on a third axis (A5), a third deflector (29) interposed between said first device (21) and said other conveying device (28) so as to allow maintenance of a reserve of particles in the tank (6) and to transfer particles from said reserve to said other device (28) and thence to said first device (21) upon rotation of said devices.

15. Apparatus according to claim 14 wherein said second deflector (22) stretches over a distance of the order of one centimeter, between said member (14) and said first conveying device (21) and leaves between itself and said first conveying device (21) a space at most equal to one millimeter and between itself and said conveying member (14) a space of the order of 5 mm.

16. Apparatus according to claim 15 wherein the solid particles are capable of attraction by a magnet, and said first conveying device (21) and said conveying member (14) have magnetic surfaces.

17. Apparatus according to claim 6 further including at least one other cylindrical conveying device (28) mounted for rotation in said tank on a third axis (A5), a third deflector (29) interposed between said first device (21) and said other conveying device (28) so as to allow maintenance of a reserve of particles in the tank (6) and to transfer particles from said reserve to said other device (28) and thence to said first device (21) upon rotation of said devices.

18. Apparatus according to claim 17 wherein said second deflector (22) stretches over a distance of the order of one centimeter, between said member (14) and said first conveying device (21) and leaves between itself and said first conveying device (21) a space at most equal to one millimeter and between itself and said conveying member (14) a space of the order of 5 mm.

19. Apparatus according to claim 13 further including at least one other cylindrical conveying device (28) mounted for rotation in said tank on a third axis (A5), a third deflector (29) interposed between said first device (21) and said other conveying device (28) so as to allow maintenance of a reserve of particles in the tank (6) and to transfer particles from said reserve to said other device (28) and thence to said first device (21) upon rotation of said devices.

20. Apparatus according to claim 19 wherein said second deflector (22) stretches over a distance of the order of one centimeter, between said member (14) and said first conveying device (21) and leaves between itself and said first conveying device (21) a space at most equal to one millimeter and between itself and said conveying member (14) a space of the order of 5 mm.

* * * * *